US005164778A

United States Patent [19]

Tanabe et al.

[11] Patent Number: 5,164,778

[45] Date of Patent: Nov. 17, 1992

[54] IMAGE FORMING APPARATUS WITH OZONE DETECTION AND DEODORIZER

[75] Inventors: Hiroshi Tanabe, Kawasaki; Minoru Iwamoto, Yokohama; Tsuneo Kurotori; Ichiro Tsuruoka, both of Tokyo; Manabu Mochizuki, Yokohama; Itsuo Ikeda, Sagamihara, all of Japan

[73] Assignee: Ricoh Company, Ltd., Tokyo, Japan

[21] Appl. No.: 607,462

[22] Filed: Oct. 31, 1990

[30] Foreign Application Priority Data

Nov. 2, 1989 [JP] Japan ..... 1-286578

[51] Int. Cl.[5] ..... G03G 21/00

[52] U.S. Cl. ..... 355/215

[58] Field of Search ..... 355/215, 260, 203, 205, 355/206, 208; 430/105; 422/98; 55/387, DIG. 42

[56] References Cited

U.S. PATENT DOCUMENTS 3,793,205 2/1974 Metcalfe et al. ..... 430/115 X
4,343,765 8/1982 Elston et al. ..... 422/122 X
4,760,423 7/1988 Holtje et al. ..... 355/215
4,853,735 8/1989 Kodama et al. ..... 355/215
4,885,929 12/1989 Kasahara et al. ..... 422/98 X

FOREIGN PATENT DOCUMENTS 0109484 5/1988 Japan .

*Primary Examiner*—A. T. Grimley
*Assistant Examiner*—Christopher Horgan
*Attorney, Agent, or Firm*—Oblon, Spivak, McClelland, Maier & Neustadt

[57] ABSTRACT

A control device for image forming equipment capable of reducing ozone ascribable to an image forming process and detecting failures of the equipment caused by the ozone. Mists are produced from a liquid developer which is a toner-dispersed carrier liquid containing silicone oil during developing, image transferring and fixing steps. The mists and the ozone are discharged to the outside of the equipment by a fan. A filter liquifies the mists and ozone by mixing them together. Errors are detected on the basis of ozone concentration which is sensed by an ozone concentration sensor.

11 Claims, 8 Drawing Sheets

IMAGE FORMING APPARATUS WITH OZONE DETECTION AND DEODORIZER

BACKGROUND OF THE INVENTION

The present invention relates to electrophotographic image forming equipment and, more particularly, to a control device for electrophotographic image forming equipment capable of reducing ozone ascribable to the image forming process of the equipment and detecting errors of the equipment caused by the ozone.

A copier, facsimile transceiver, laser beam printer or similar electrophotographic image forming equipment is extensively used today. An electrophotographic procedure includes a step of uniformly charging an image carrier, a step of transferring a developed image or toner image from the image carrier to a paper sheet, a step of separating the paper sheet with the toner image from the image carrier, and a step of dissipating the charge remaining on the image carrier after the image transfer. These steps are implemented with at least chargers for corona discharge and, therefore, generate ozone which gives out an offensive smell. Regarding an electrophotographic copier of the type using a liquid developer, the smell particular to the ozone has not been a problem since such a type of copier does not emit a noticeable amount of ozone to the outside, i.e., mists of liquid developer produced in the copier contact and thereby decompose ozone.

However, modern copiers with high-speed and large format copying capabilities are implemented with chargers having greater power to be stably operable. The increase in the power of chargers directly translates into the increase in the concentration of ozone to be produced in the copier, influencing even the copier of the type using a liquid developer. Typically, the liquid developer for use with a copier comprises a toner-dispersed solvent or carrier liquid which is based on isoparaffine. The mists of the solvent contact the ozone to lower the concentration of the latter. The problem with an isoparaffin-based solvent is that heat oxidizes it and thereby causes it to give out an offensive smell. In a copier, for example, the solvent vaporizes during the fixing step due to heat generated by a heater which is incorporated in a fixing roller, resulting in an foul smell. Hence, mists of the solvent evaporated at the fixing step do not mix with the ozone. Customarily, therefore, it has been expected that the ozone automatically contacts the mists generated around a photoconductive drum, or image carrier, which are derived partly from the rotation of a cleaning roller, partly from the rotation of the developing roller, and partly from the separation of a paper sheet from the drum.

However, simply expecting the automatic contact of the ozone with the mists generated around the drum is too negative and inefficient to achieve sufficient reduction in the concentration of ozone.

SUMMARY OF THE INVENTION

It is therefore an object of the present invention to provide a control device for electrophotographic image forming equipment capable of reducing the amount of ozone particular to an image forming process.

It is another object of the present invention to provide a control device for electrophotographic image forming equipment capable of detecting errors of the equipment caused by ozone particular to an image forming process.

A control device for image forming equipment of the type performing a latent image forming step which electrostatically forms a latent image associated with a document image on an image carrier, a developing step for developing the latent image, an image transferring step for transferring the developed image to a paper sheet, and a fixing step for fixing the transferred image on the paper sheet of the present invention comprises mist generating elements for generating mists which mix with ozone ascribable to the image forming and image transferring steps and thereby decompose the ozone to reduce the ozone concentration and offensive smell of the ozone, and a discharging device for sucking and mixing the ozone and the mists to discharge the ozone and mists to the outside of the image forming equipment.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
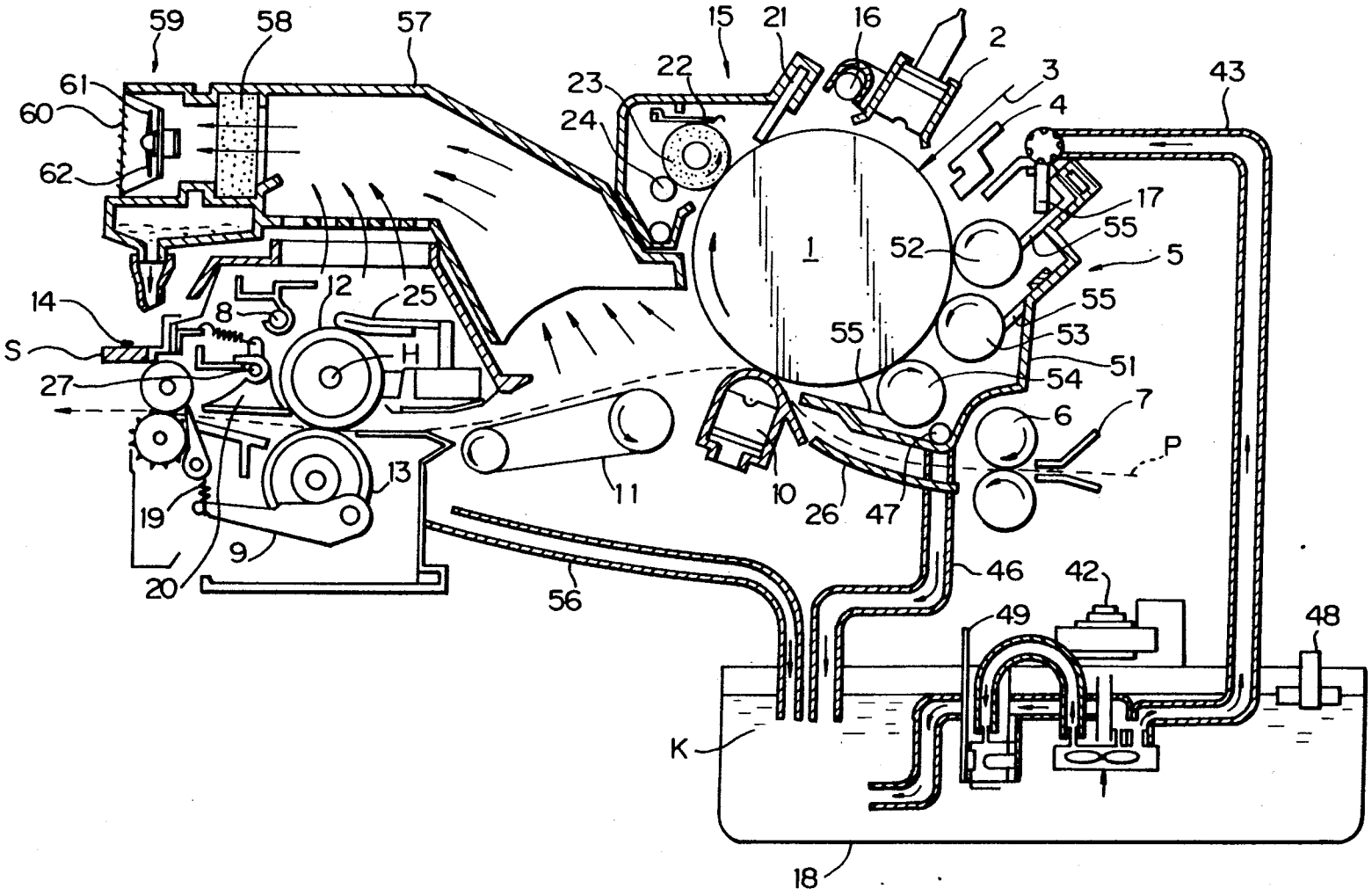
FIG. 1 is a section showing an electrophotographic copier using a liquid developer and incorporating an embodiment of the control device in accordance with the present invention.

Referring to FIG. 1 of the drawings, an electrophotographic copier using a liquid developer and incorporating an embodiment of the present invention is shown. As shown, the copier has a photoconductive drum, or image carrier, 1 which is rotatable at a predetermined speed in a direction indicated by an arrow in the figure. The rotation of the drum 1 occurs during and immediately before and immediately after a copying operation. After the drum 1 has been uniformly charged in the dark by a main charger 2, imagewise light 3 is focused onto the drum 1 by an exposing device, not shown. As a result, a latent image is electrostatically formed on the surface of the drum 1. An eraser 4 dissipates the charge from axially opposite end portions of the drum 1 where the latent image does not exist, i.e., non-image areas. While the latent image passes a developing device 5, a liquid developer develops it and thereby forms a corresponding toner image. A paper sheet P fed from a paper feeding device, not shown, is routed through a transport guide 7, a transport roller pair 6 and a transport guide 26. A transfer charger 10 transfers the toner image from the drum 1 to the paper sheet P being so transported. The paper sheet P carrying the toner image thereon and moved away from a nip section, not shown, is transported by a belt 11 to a fixing device 14. The fixing device 14 has a heat roller 12 accommodating a heater H thereinside, and a pressure roller 13. When the paper sheet P with the toner image passes the nip portion of the rollers 12 and 13, the toner image is fixed on the paper sheet P by heat generated by the heater H. A cam 9 is constantly urged upward by a spring 19 to in turn urge the pressure roller 13 upward. The paper sheet P with the fixed toner image is driven out of the copier to a copy tray, not shown. The copier has a temperature sensor (thermistor) responsive to the temperature of the heat roller 12, a temperature fuse 8, a separating pawl 20, a silicone-coated felt, in addition to the various component parts and elements described above.

The toner remaining on the surface of the drum 1 after the image transfer is removed while it passes a cleaning unit 15. Subsequently, a charger 16 implemented with a discharge lamp or a discharger dissipates the charge remaining on the surface of the drum 1 to prepare the drum 1 for another copying cycle. The cleaning unit 15 has a sponge roller 23 made of a foaming material, and a blade 21. The surface of the roller 23 and one end of the blade 21 are held in contact with the drum 1 to scrape off the liquid developer remaining on the drum 1. A squeeze roller 24 constantly presses itself against the sponge roller 23 to squeeze off the liquid developer having been soaked into the roller 23. A plate 22 is provided for the purpose of distributing a cleaning liquid.

The developing device 5 has a casing 51 which accommodates therein a first and a second developing roller 52 and 53, respectively, and a squeeze roller or reverse roller 54. The rollers 52, 53 and 54 are located in close proximity to the drum 1. Specifically, the first and second developing rollers 52 and 53 each is spaced apart from the surface of the drum 1 by a small gap, e.g. 0.1 millimeter. The developing rollers 52 and 53 are rotated in the same direction but at a higher speed than the surface of the drum 1. Cleaning members in the form of scrapers 55 each is fixed at one end thereof to the casing 51 and is held in contact with respective one of the rollers 52, 53 and 54, thereby removing the toner from the associated roller at all times.

A developer supply nozzle 17 is located above the first developing roller 52 such that the liquid developer flows down toward the roller 52. The first and second developing rollers 52 and 53 each transports the developer to the drum 1 in a uniform distribution, whereby the latent image on the drum 1 is developed. The squeeze roller 54 is rotated in the opposite direction to the developing rollers 52 and 53 to remove the remaining developer from the drum 1. The scraper 55 associated with the squeeze roller 54 cleans the surface of the latter. The so removed developer is returned to a developer tank 18 via an opening 47 formed through the bottom of the casing 51 and a return conduit 46. The developer K stored in the developer tank 18 is a toner- or resin-dispersed carrier liquid containing silicone oil having a siloxan structure which is sparingly vaporizable (e.g. methylphenyl silicone KF-58 available from Shinetsu Silicon (Japan)). A motor 42 is a pumping and agitating motor which drives a pump to feed the liquid developer K from the tank 18 to the developing device 5 via a feed conduit 43. The toner concentration of the developer K is controlled on the basis of an output of a toner density sensor 49. A float sensor 48 is responsive to the level of the liquid K in the tank 18.

The liquid K is also fed to the cleaning unit 15 via a branch conduit, not shown, located upstream of the developer supply nozzle 17 of the developing device 5. The cleaning unit 15 has an opening, not shown, communicating to the return conduit 46 via a conduit, not shown. Hence, the liquid K fed to the cleaning unit 15 is also returned to the developing tank 18.

A duct 57 is disposed above the fixing device 14 and has vent holes above the fixing device 14. A filter 58 and a suction fan 59 are provided at the outlet side of the duct 57. The fan 59 allows the duct 57 to collect both of the ozone ascribable to the chargers 10 and 16 and the mists of solvent produced around the fixing device 14 and drum 1. As a result, the ozone and the mists of solvent are mixed together by the duct 57 and filter 58. The mists around the drum 1 are ascribable partly to the rotation of the sponge roller 23, partly to the rotation of the rollers 52 to 54, and partly to the separation of the paper sheet from the drum 1 which occurs after image transfer. The filter 58 promotes efficient contact of the ozone and mists collected by the duct 57, while facilitating the liquefaction of the collected mists. The carrier liquid liquefied by the filter 58 is returned to the developer tank 18 by a return conduit 56. The fan 59 comprises blades 61 and is driven by a motor 62 to suck the ozone produced by the chargers 10 and 16 and the mists of solvent forming around the fixing device 14 and drum 1. At the same time, the fan 59 discharges the ozone and oxygen decomposed by the filter 58 via an outlet 60 which is located at the front of the copier. Should the suction by the fan 59 be excessively strong, it would deprive the fixing device 14 of the heat. In the light of this and for an energy saving purpose, the sucking force of the fan 59 is maintained weak enough to be balanced with the fixing thermal efficiency.

An ozone concentration sensor S is located in the vicinity of the copy outlet of the copier to sense the concentration of ozone. The fan 59 is controlled on the basis of the ozone concentration sensed by the sensor S. Specifically, the fan 59 is activated when the ozone concentration exceeds a predetermined upper limit (0.01 parts per million) and deactivated when it decreases to a predetermined lower limit (0.03 parts per million). It is possible, therefore, to detect the malfunction of the fan 59 and the failure of the sensor S itself. When such an occurrence is detected, the illustrative embodiment deenergizes the main motor of the copier while alerting the operator to the occurrence by a display or the like.

Figure 2:
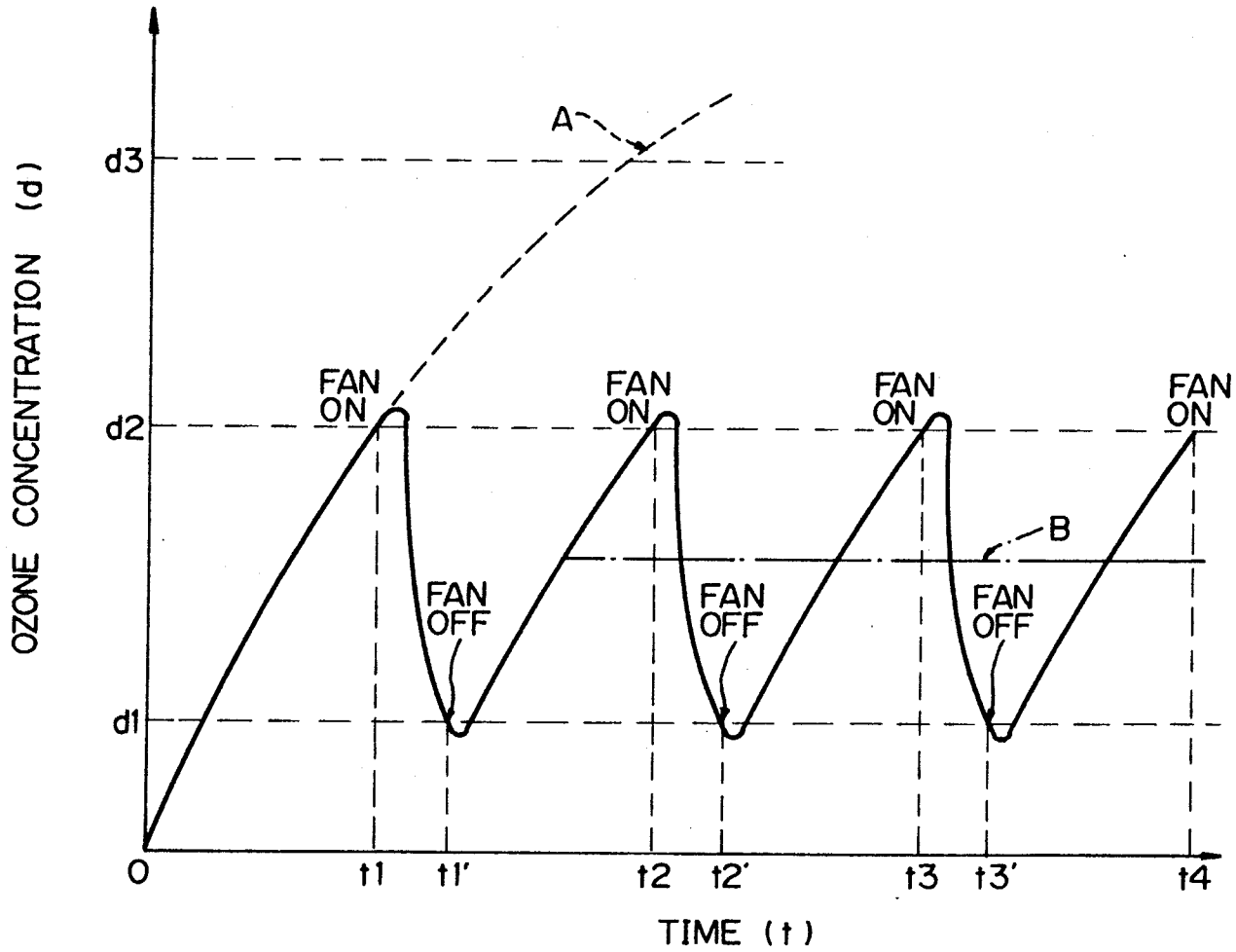
FIG. 2 is a graph indicative of a relation between the time and the ozone concentration which was determined with the copier of FIG. 1 by a continuous copy mode.

A reference will be made to FIG. 2 for describing the advantage of controlling the fan 59 in response to the output of the ozone concentration sensor S. In FIG. 2, the abscissa and the ordinate indicate respectively the duration of continuous copying operation as counted from the start and the concentration of ozone. As FIG. 2 indicates, the ozone concentration increases monotonously (0 to $d_2$) with the lapse of time. When the ozone concentration reaches a predetermined upper limit ($d_2$=0.01 parts per million), the fan 59 is activated. Then, the ozone concentration slightly increases and, thereafter, decreases monotonously. As soon as the ozone concentration decreases to a predetermined lower limit ($d_1$=0.003 parts per million), the fan 59 is deactivated. Then, after slightly decreasing, the ozone concentration again begins to increase. When the ozone concentration reaches the upper limit ($d_2$) again, the fan 59 is activated again. Such a procedure is repeated until the continuous copying operation has been ended. More specifically, the fan 59 remains operative during the time $t_1$ to $t'_1$, $t_2$ to $t'_2$, $t_3$ to $t'_3$, and so on.

Assume that ozone is not decomposed due to the failure of the fan 59, for example. Then, the ozone concentration will increase, as indicated by a dotted curve A in FIG. 2. On the other hand, assuming that the sensor S has failed, the ozone concentration cannot be controlled. Specifically, despite that the ozone concentration varies, the output of the sensor S remains substantially constant, as indicated by a dash-and-dot line in FIG. 2. Hence, regarding the condition A, it can be determined that an error has occurred when concentrations higher than a certain concentration ($d_3$=0.05 parts per million) have been detected over a predetermined period of time (1 minute). Regarding the condition B, such a decision can be made when a substantially constant rate of variation in concentration has continued over a predetermined period of time. In the event of an error, the main motor of the copier is deenergized to stop the copying operation, as stated earlier.

Figure 3:
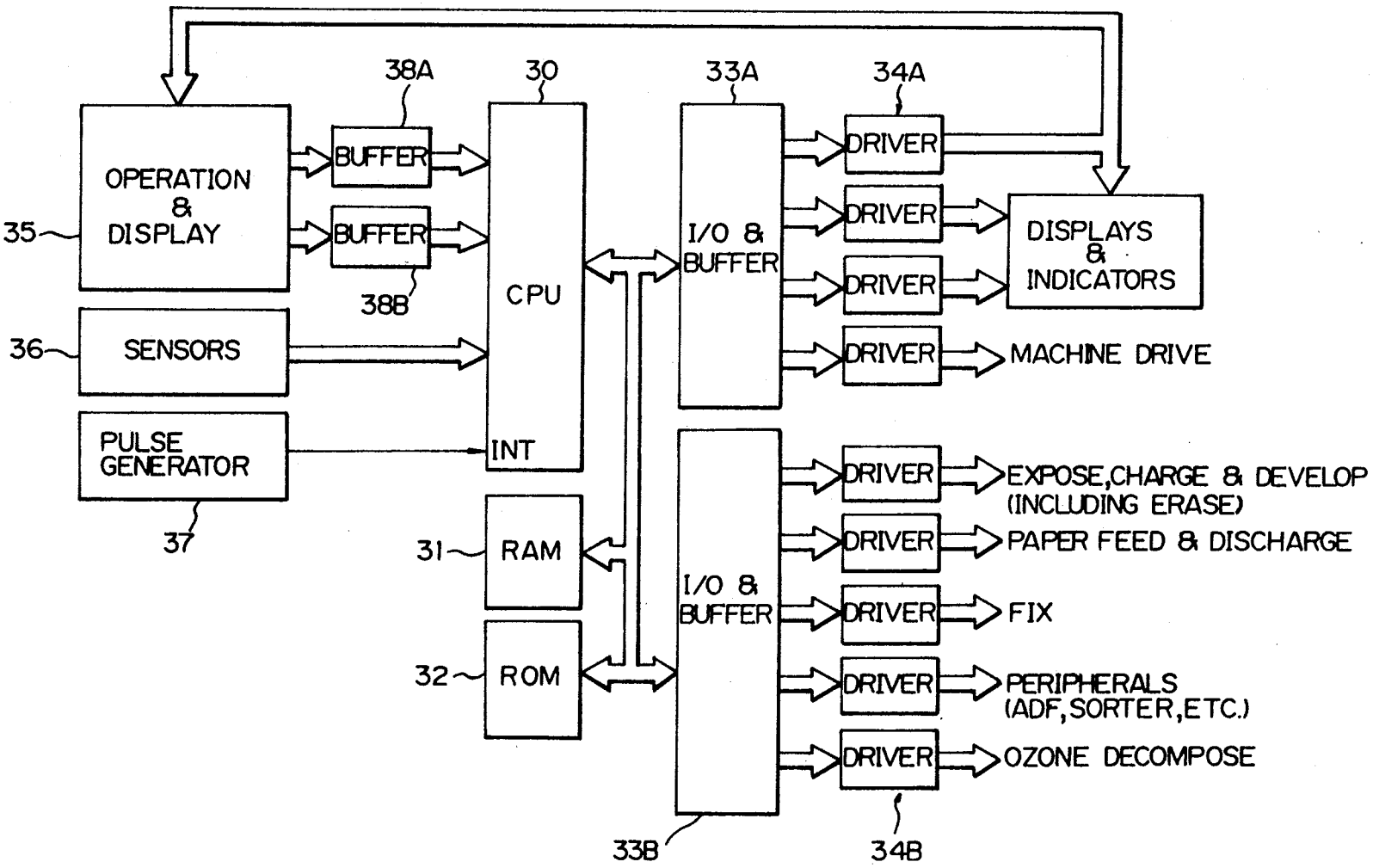
FIG. 3 is a block diagram schematically showing electric circuitry of the present invention applied to the equipment of FIG. 1.

Referring to FIG. 3, a control system of the illustrative embodiment will be described. As shown, the control system includes a CPU 30 and a RAM 31, a ROM 32 and input/output (I/O) port and buffers 33A and 33B which are connected to the address bus, control bus and data bus of the CPU 30. Drivers 34A and drivers 34B selectively energize various loads in response to the outputs of the I/O and buffers 33A and 33B, respectively. An operation and display board 35 has a print key for starting a copying operation, numeral keys, a cassette select key, an exposure select key, a magnification select key, a copy number display, an error display, etc. Sensors 36 responsive to the various internal conditions of the copier include the temperature sensor 27 responsive to the fixing temperature of the device 14, and float sensor 48 responsive to the liquid level in the developer tank. A pulse generator 37 generates pulses synchronous to the rotation of the drum 1. The outputs of the operation and display board 35 are applied to the CPU 30 via buffers 38A and 38B. The control over the decomposition of ozone, i.e., the on-off control of the motor 62 for driving the fan 59 is effected by an exclusive driver 34B for the motor 62 via the I/O port and buffer 33B.

Figure 4:
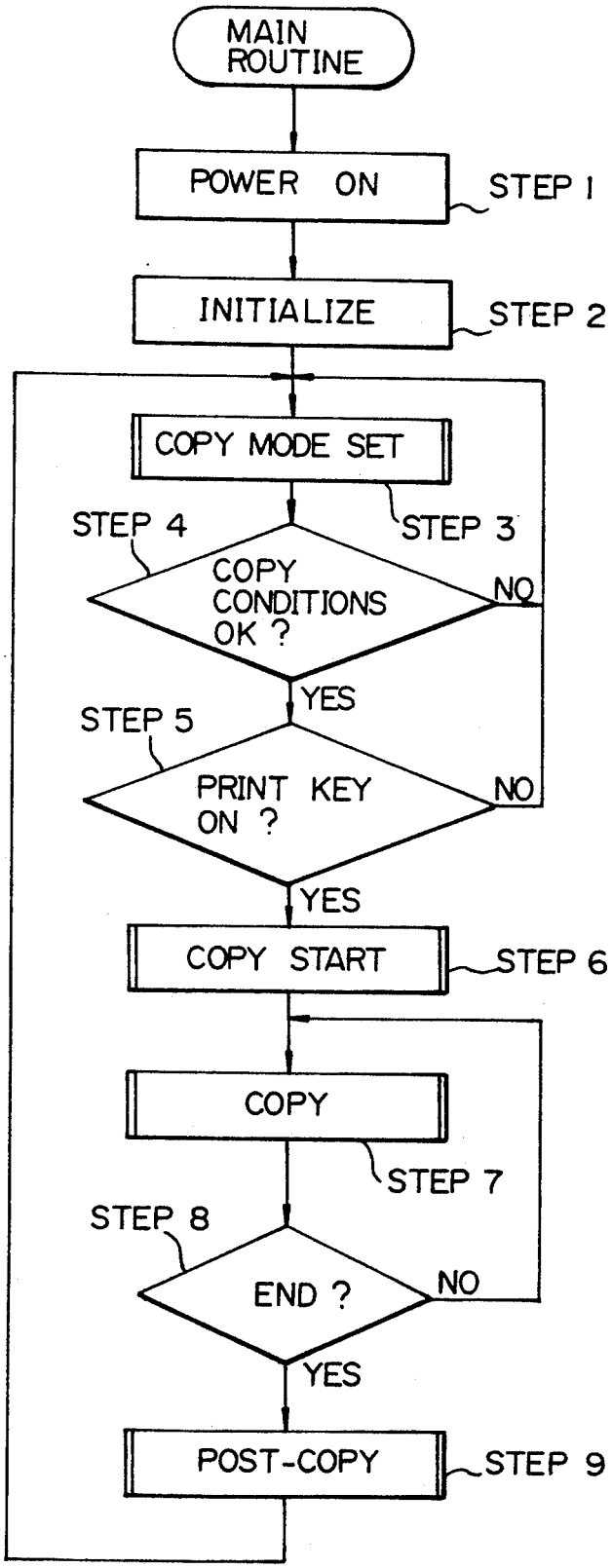
FIGS. 4 to 9 are flowcharts demonstrating specific operations of a CPU included in the circuitry of FIG. 3.

FIG. 4 is a flowchart representative of the main routine to be executed by the CPU 30, FIG. 3. As shown, on the turn-on of power (STEP 1), the CPU 30 initializes the copy mode including the setting of the heater H of the heat roller 12, the set number of copies, and magnification (STEP 2). Thereafter, the CPU 30 sets up a copy mode in response to information entered by the operator on the keys (STEP 3), and then it checks the warm-up of the heater H and other various copying conditions (STEP 4). Thereupon, the CPU 30 waits for the depression of the print key (STEP 5).

Figure 5:
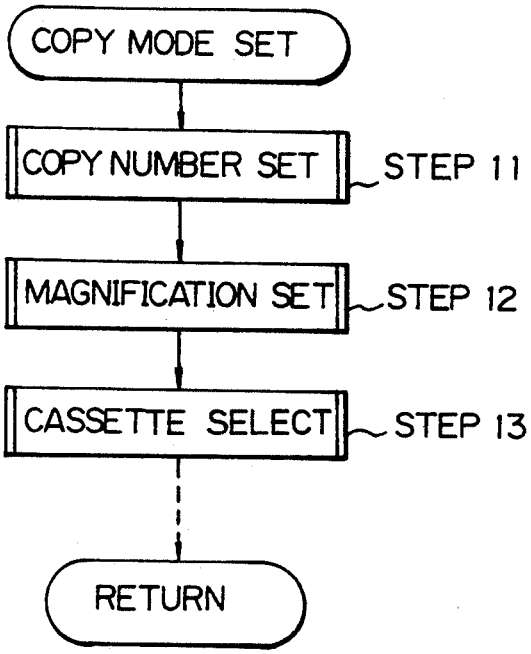

FIG. 5 shows the STEP 3 of FIG. 4 in detail. As shown, the STEP 3 is made up of copy number set subroutine (STEP 11), a magnification set subroutine (STEP 12), a cassette select subroutine (STEP 13), and other subroutines.

In FIG. 4, the CPU 30 reached the STEP 5 starts on copy start processing (STEP 6) as soon as the print key switch is turned on.

Figure 6:
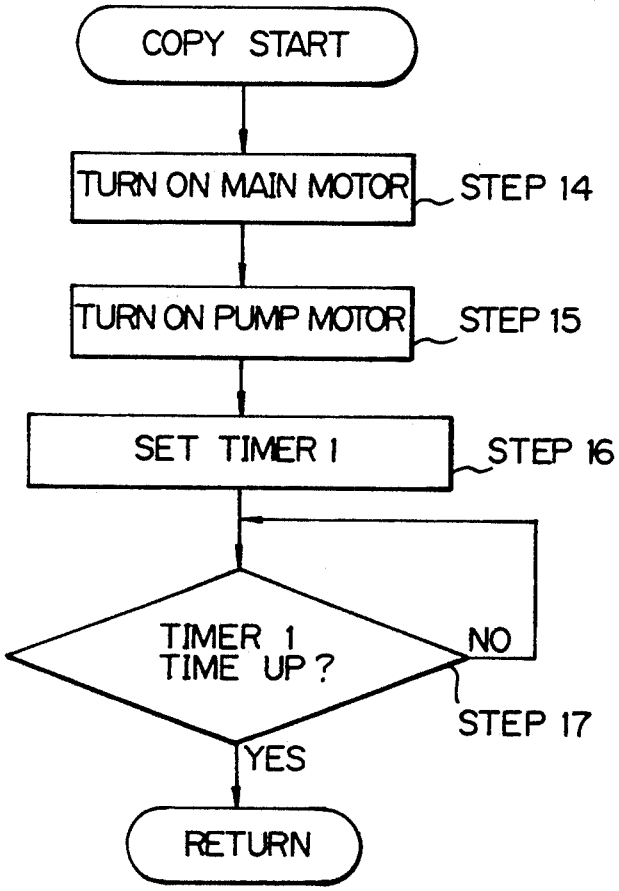

The copy start processing or STEP 6 is shown in detail in FIG. 6. This processing begins with a STEP 14 for turning on the main motor, not shown, to drive the drum 1. Then, the pump motor 42 is energized (STEP 15) to pump the liquid developer K from the tank 18 to the developing unit 5 and cleaning unit 15. Subsequently, the time necessary for the developing device 5 to be filled with the liquid K after the energization of the motor 42 is set in a timer (program time) 1, and the timer is started (STEP 16). When the time set in the timer 1 expires (STEP 17), the program advances to copy processing (STEP 7) shown in FIG. 4.

Figure 7:
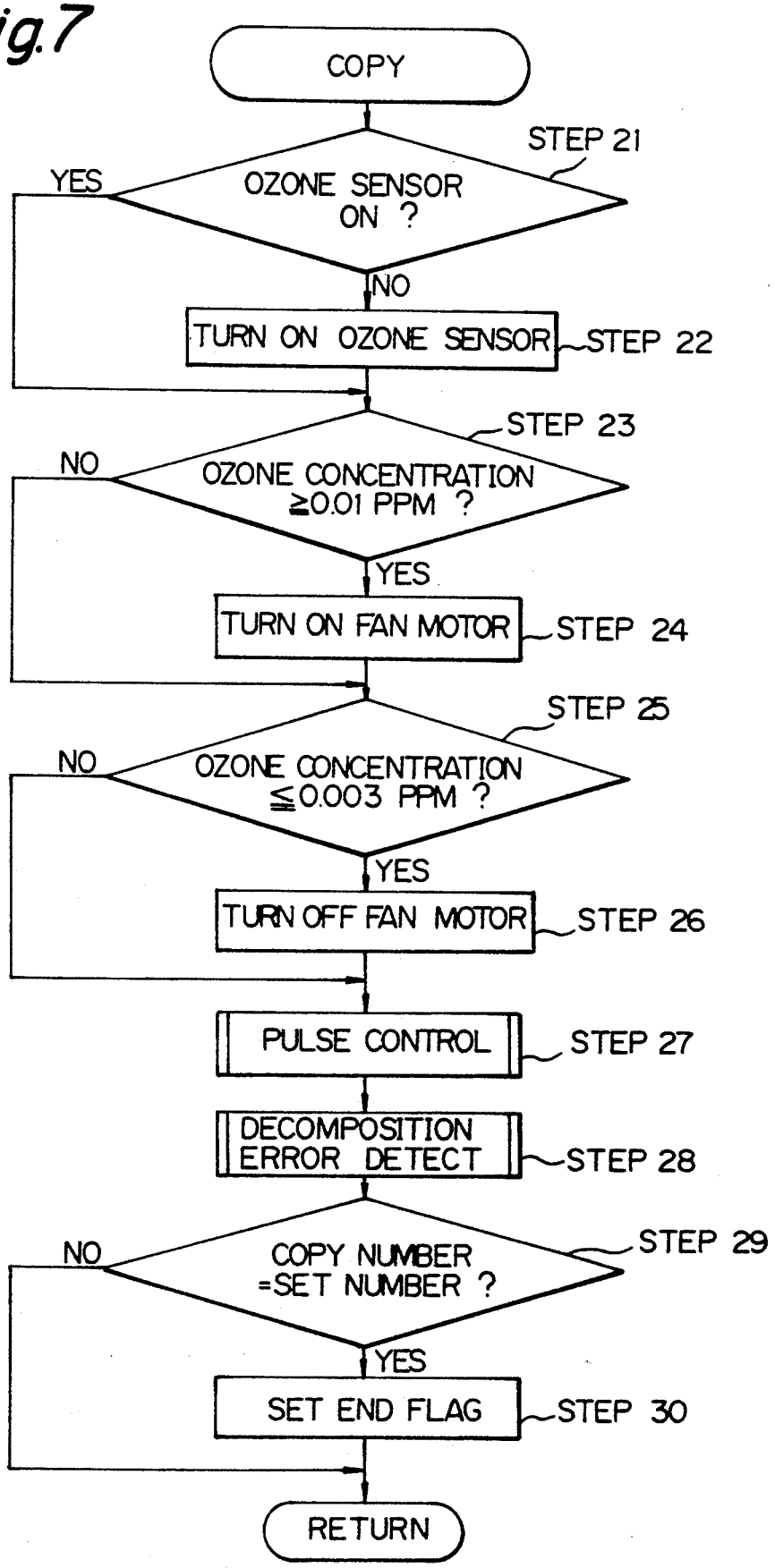

FIG. 7 shows the contents of the copy processing or STEP 7, FIG. 4. To begin with, the CPU 30 turns on the ozone concentration sensor S (STEPs 21 and 22) and then checks the sensor S to see if the ozone concentration has reached the upper limit (0.01 parts per million) (STEP 23). Until the ozone concentration reaches the upper limit, the CPU 30 maintains the fan 59 inoperative and executes pulse control processing (STEP 27). In the STEP 27, the output pulses of the pulse generator, FIG. 3, which is interlocked with the drum 1 are counted to sequentially control the image formation including the turn-on of the lamp, charger and scanner as well as the copying process including paper feed, paper transport and image transfer. When the copying operation is completed, the CPU 30 determines whether or not the set number of copies has been reached (STEP 29). If the answer of the STEP 29 is NO, the CPU 30 does not set an end flag and, instead, returns to the copy routine to repeat the copying operation. When the ozone concentration reaches 0.01 parts per million as determined in the STEP 23, the CPU 30 energizes the motor 62 to drive the fan 59 (STEP 24). As the ozone concentration decreases to the lower limit (0.003 parts per million) due to the operation of the fan 59 (STEP 25), the CPU 30 deenergizes the motor 62, i.e., the fan 59 (STEP 26). This is repeated by the STEPs 27, 28 and 29. When the set number of copies have been produced as determined in the STEP 29, the CPU 30 sets the end flag (STEP 30) and then advances to post-copy processing (STEP 9), FIG. 4. In this manner, the fan 59 is activated when the ozone concentration reaches 0.01 parts per million and is deactivated when it decreases to 0.003 parts per million. Such a procedure is repeated intermittently.

Figure 8:
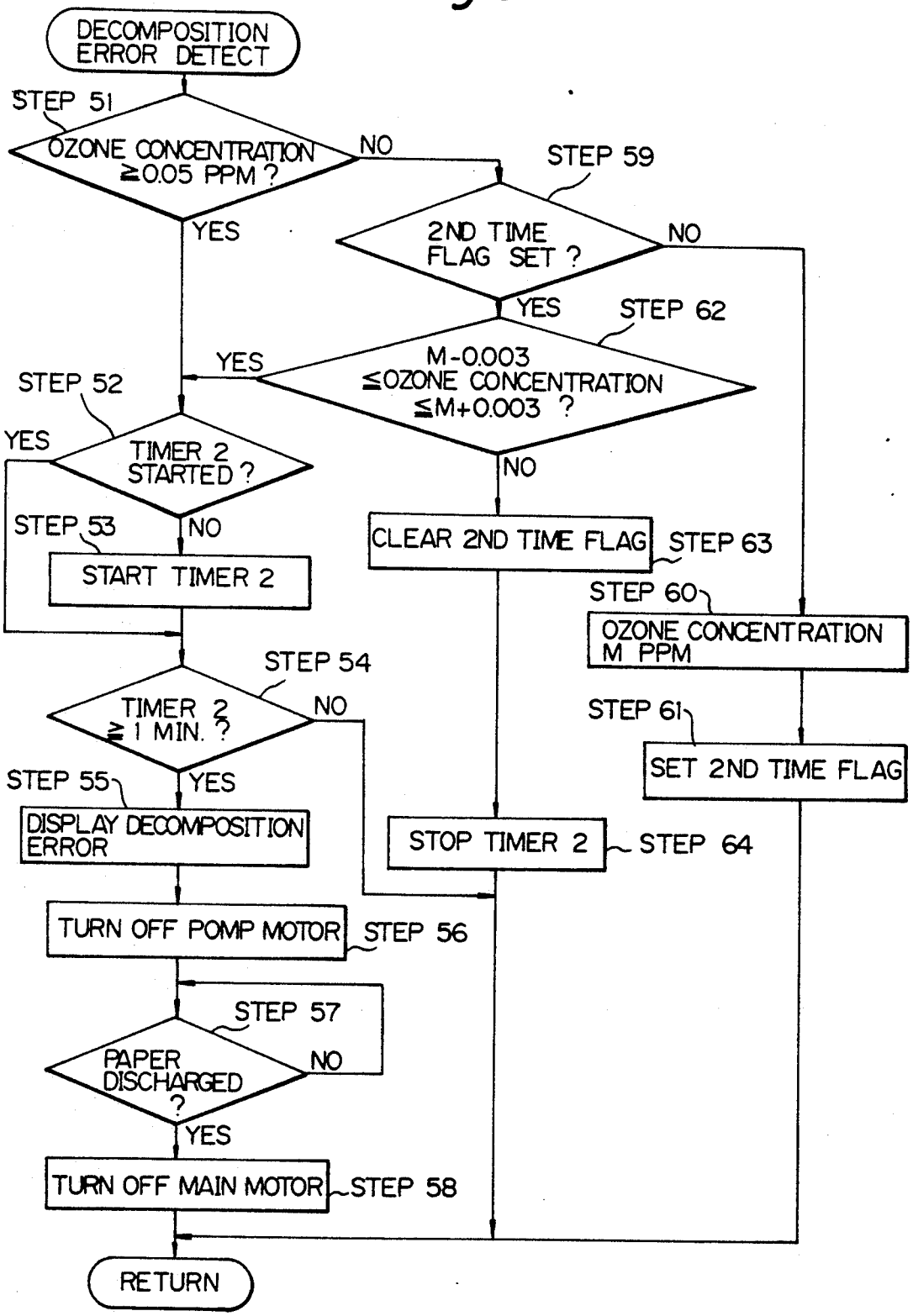

FIG. 8 shows the contents of the error detect processing or STEP 28, FIG. 7. As shown, the CPU 30 determines whether or not the ozone concentration sensed by the sensor S is higher than a predetermined reference value (assumed to be 0.05 parts per million) (STEP 51). If the answer of the STEP 51 is YES (condition A, FIG. 2), the CPU 30 starts a timer 2 (STEPs 52 and 53). When the concentration being sensed by the sensor S does not become smaller than the reference value before the timer 2 counts 1 minute, the CPU 30 determines that the decomposition of ozone has failed (failure of the fan 59, for example), displays or indicates the error (STEP 55), deenergizes the pump motor 42 (STEP 56), and deenergizes the main motor (STEP 58) after the discharge of the paper sheet (STEP 57).

When the ozone concentration is smaller than the reference value (0.05 parts per million) as determined in the STEP 51, the CPU determines whether or not a second time flag has been set (STEP 59). Since the second time flag is not set at first, the program advances to a STEP 60 for writing the sensed ozone concentration to a register m and setting the second time flag (STEP 61). If the ozone concentration remains smaller than the reference value (0.05 parts per million) thereafter, the CPU 30 executes a step 59 and then to a STEP 62 since the second time flag has been set. In the STEP 62, the CPU 30 compares the latest concentration with the concentration m (sensed last time) stored in the register m to see if the following relation holds:

$$(m-0.003) \leqq \text{latent concentration} \leqq (m+0.003) \quad (1)$$

Specifically, since the error detection regarding the decomposition of ozone is effected every time a single copy is produced (STEP 28, FIG. 7), m is the concentration before single copy processing while the lastest concentration is the concentration after the same copy processing. Assume that all of the image formation and the fan 59 and sensor S are free from errors. Then, when the fan 59 is not operating, there holds the following relation:

$$\text{latest concentration} > (m + 0.003) \quad (2)$$

When the fan 59 is operating, the concentration increases and decreases, as shown in FIG. 2. Hence, $$(m - 0.003) > \text{latest concentration} \quad (3)$$

or $$\text{latest concentration} > (m + 0.003) \quad (4)$$

None of the relations (2) to (4) shown above satisfies the relation (1).

When the relation (1) is satisfied as determined in the STEP 62, the CPU 30 turns on the timer 2 by determining that an error has occurred (STEP 52 and 53). When the relation (1) holds continuously more than 1 minute, i.e., when the timer 2 counts more than 1 minute (STEP 54), the CPU 30 determines that the sensor S, for example, has failed and displays the ozone decomposition error (STEP 55), deenergizes the pump motor 42 (STEP 56), and then deenergizes the main motor (STEP 59) after the discharge of the paper sheet (STEP 57). If the relation (1) does not hold or if it stops holding within one minute, the CPU 30 clears the second time flag (STEP 63), turns off the timer 2 (STEP 64), and then returns to the STEP 29 of FIG. 7. After the copying operation, the CPU 30 sets the end flag (STEP 30) and advances to the post-copy processing (STEP 9, FIG. 4).

Figure 9:
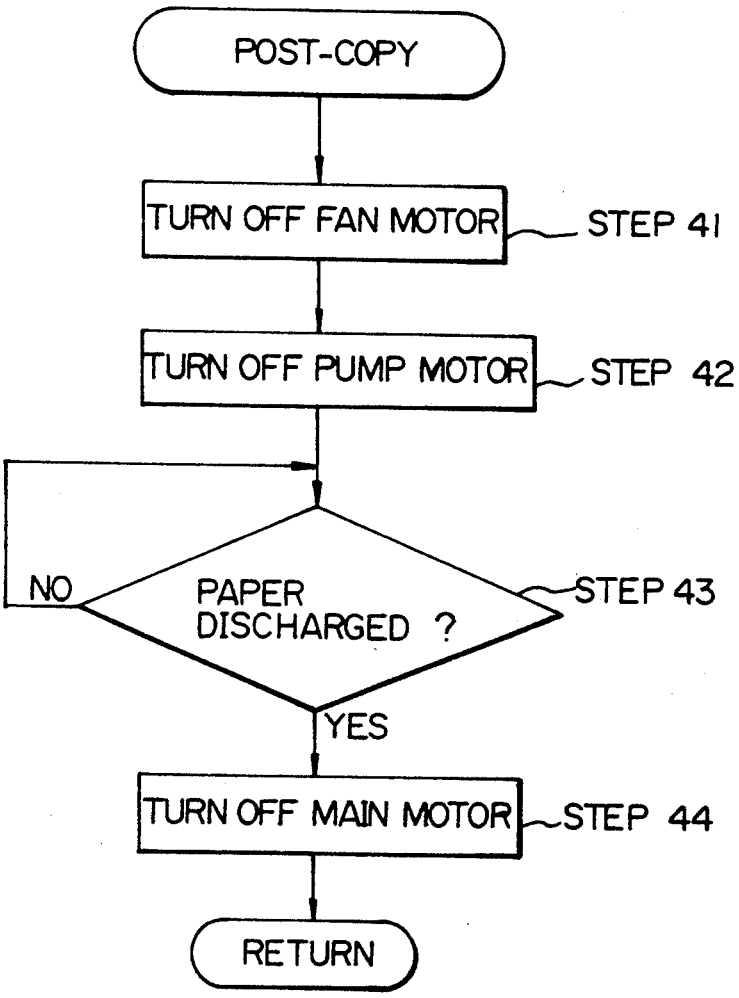

FIG. 9 shows the post-copy processing or STEP 9 in detail. As shown, the motor 62 for driving the fan 59 is turned off (STEP 41), and so is done the pump motor 42 (STEP 42). After the paper sheet has been fully driven out of the copier (STEP 43), the main motor is deenergized (STEP 44).

As shown in FIG. 4, the CPU 30 completed the post-copy processing or STEP 9 returns to the copy condition setting procedure or STEP 3. Then, the CPU 30 repetitively executes the loop including the STEPS 3, 4, 5, 6, 7, 8, and 9.

Experiments were conducted to prove the advantages of the illustrative embodiment, under the following conditions:

linear velocity: 266 mm/sec
fixing temperature: 140±10° C.
ambient conditions: 23±2° C., 55±5%
room: 30 $m^3$ without ventilation
position: 20 cm remote from outlet
paper: Ricoh TYPE 6200 (size A4)
carrier of developer: KF-58 (methylphenyl silicone available from Shinetsu Silicon).

Specifically, the fan 59 was operated continuously under the above conditions while the copying cycle was repeated to produce 999 copies. After 3 hours of copying operation, the ozone concentration was measured to be 0.002 parts per million. For comparison, the copying operation was repeated to produce 99 copies (about 1/10) with the fan 59 held inoperative and at an interval of 5 minutes, in which case the ozone concentration was measured to be 0.027 parts per million. Thus, the duct 57 and fan 59 realize unprecedented reduction in the concentration of ozone.

Silicone oil remains stable against high temperatures, gives out no offensive smells, and decomposes ozone efficiently. In accordance with the present invention, the drum 1, developing device 5 and fixing device 14 produce the mists of silicone oil, while the duct 57 and fan 61 mix the mists and the ozone ascribable to the chargers 2 and 10 and then discharges them to the outside. As a result, the mists decompose the ozone and thereby reduces the concentration of ozone being emitted to the outside as well as the offensive smell particular thereto. The smells ascribable to the mists are not noticeable and, therefore, do not annoy the operator. Assume that ozone is generated in an unusually great amount due to the failure of corona discharges or unusual voltage, or that ozone cannot be effectively removed due to the failure of the fan. Then, as the ozone concentration sensed by the sensor S increases the predetermined upper limit, error information is produced to alert the operator to such an occurrence. Error information is also produced when the rate of variation of ozone concentration becomes substantially zero during the course of image forming operation. The zero variation rate will occur when the sensor S or the drum 1 or similar component that generates ozone fails. In this manner, the present invention automatically detects the errors of the parts and elements which are associated with the removal of ozone while informing the operator of such errors.

It is to be noted that the present invention is applicable not only to an image forming apparatus using a liquid developer but also to an image forming apparatus using a dry developer.

Various modifications will become possible for those skilled in the art after receiving the teachings of the present disclosure without departing from the scope thereof.

What is claimed is:

1. A control device for image forming equipment of the type performing a latent image forming step which electrostatically forms a latent image on an image carrier, a developing step for developing said latent image, an image transferring step for transferring said developed image to a paper sheet, and a fixing step for fixing said transferred image on said paper sheet, said device comprising:

mist generating means for generating mists which mix with ozone ascribable to the image forming and image transferring steps and thereby decompose said ozone to reduce an ozone concentration and offensive smell of said ozone;

discharging means for sucking and mixing the ozone and the mists to discharge said ozone having a reduced ozone concentration and offensive smell to the outside of said image forming equipment;

ozone concentration sensing means for sensing the ozone concentration;

means for activating said discharging means when said ozone concentration sensed by said ozone concentration sensing means exceeds a predetermined upper limit and deactivating said discharging means when said ozone concentration sensed by said ozone concentration sensing means is below a predetermined lower limit; and means for sensing a change in the concentration of ozone so as to determine that an error has occurred in the ozone concentration sensing means when a change in the ozone concentration remains below a predetermined value over a predetermined period of time.

2. A device as claimed in claim 1, further comprising error detecting means for determining that an error has occurred when the ozone concentration sensed by said ozone concentration sensing means exceeds a predetermined value higher than said predetermined upper limit.

3. A device as claimed in claim 2, wherein said error detecting means further determines that an error has occurred when a rate of variation of ozone concentration sensed by said ozone concentration sensing means lies in a predetermined range over a predetermined period of time.

4. A device as claimed in claim 1, wherein the mists are produced from a developer used in the developing step.

5. A device as claimed in claim 4, wherein the developer comprises a liquid developer which is a toner-dispersed carrier liquid containing silicone oil.

6. A device as claimed in claim 5, wherein the mist is produced from the developer during the developing, image transferring and fixing steps.

7. A device as claimed in claim 6, wherein said discharging mean comprises a duct for guiding the ozone and the mists, and a fan for discharging said ozone and said mists guided by said duct by suction to the outside.

8. A device as claimed in claim 7, wherein said discharging means further comprises a filter for liquefying the ozone and the mists sucked by said fan by mixing.

9. A device as claimed in claim 2, wherein said error detecting means comprises means for terminating a copying operation when said error is detected by said error detecting means.

10. A device as claimed in claim 3, wherein said error detecting means comprises means for terminating a copying operation when said error is detected by said error detecting means.

11. A control device for image forming equipment of the type performing a latent image forming step which electrostatically forms a latent image on an image carrier, a developing step for developing said latent image, an image transferring step for transferring said developed image to a paper sheet, and a fixing step for fixing said transferred image on said paper sheet, said device comprising:

mist generating means for generating mists which mix with ozone ascribable to the image forming and image transferring steps and thereby decompose said ozone to reduce an ozone concentration and offensive smell of said ozone;

discharging means for sucking and mixing the ozone and the mists to discharge said ozone having a reduced ozone concentration and offensive smell to the outside of said image forming equipment;

ozone concentration sensing means for sensing the ozone concentration and providing a signal indicative thereof;

means for activating and deactivating, during a continuous copying operation, the discharging means in response to said signal from the ozone concentration sensing means; and error detecting means comprising means for determining that an error has occurred when the ozone concentration sensed by said ozone concentration sensing means exceeds a predetermined value, and means for determining that an error has occurred when a rate of variation of ozone concentration sensed by said ozone concentration sensing means lies in a predetermined range over a predetermined period of time.

* * * * *